United States Patent [19]

Nishimura et al.

[11] 4,398,817

[45] Aug. 16, 1983

[54] MAGNETIC DEVELOPER APPARATUS FOR APPLYING TWO DIFFERENT COLORED TONERS WITH THE SAME APPLICATOR

[75] Inventors: Fuminobu Nishimura, Yokohama; Mitsuaki Kohyama, Higashi-kurume, both of Japan

[73] Assignee: Tokyo Shibaura Denki Kabushiki Kaisha, Kawasaki, Japan

[21] Appl. No.: 361,101

[22] Filed: Mar. 23, 1982

[30] Foreign Application Priority Data

Mar. 25, 1981 [JP] Japan ..... 56/42020[U]

[51] Int. Cl.[3] ..... G03G 15/01

[52] U.S. Cl. ..... 355/4; 118/645; 118/657; 355/3 DD

[58] Field of Search ..... 355/4, 3 DD, 10; 118/645, 657, 658; 430/42, 122

[56] References Cited

U.S. PATENT DOCUMENTS 3,722,993 3/1973 Egnaczak ..... 355/4 X

*Primary Examiner*—R. L. Moses

*Attorney, Agent, or Firm*—Cushman, Darby & Cushman

[57] ABSTRACT

A copying apparatus comprises a photosensitive body and a developing device. The developing device includes a first storage chamber for storing a first red toner, a second storage chamber adjacent to the first storage chamber for storing a second black toner, and a developing roller having an outer peripheral surface consisting of a first portion facing the photosensitive body, a second portion located inside the first storage chamber, and a third portion located inside the second storage chamber, and rotatable clockwise and counterclockwise. The first red toner is supplied from the first storage chamber to the photosensitive body when the developing roller rotates clockwise, and the second black toner is supplied from the second storage chamber to the photosensitive body when the developing roller rotates counterclockwise.

14 Claims, 13 Drawing Figures

MAGNETIC DEVELOPER APPARATUS FOR APPLYING TWO DIFFERENT COLORED TONERS WITH THE SAME APPLICATOR

BACKGROUND OF THE INVENTION

The present invention relates to a copying apparatus which develops electrostatic latent images by means of a developing device, more specifically to a copying apparatus provided with a developing device which supplies a developer through the rotation of a developing roller.

Conventionally, an electrostatic copying machine performs monochrome copying operation using a black color. Therefore, if a typescript to be copied includes words underlined in, for example, red ink for attention, the underline cannot help being copied in the same black color of the typewritten words. Thus, those words which are set off by the red underline in the original document may hardly be able to be distinguished from other parts or words, and may fail to attract a reader's special attention in a copy. For the copying of such a two-color original document, it may be possible to use a multicolor electrostatic copying machine that has recently been developed. The copying machine of this type, however, is too expensive to enjoy reasonable running cost per copy. Moreover, it is uneconomical to use a multicolor copying machine for only two-color copying. Accordingly, there has conventionally been an increasing demand for a two-color electrostatic copying machine of a simple construction, more specifically an electrostatic copying apparatus for two-color copying using a black color and another.

Namely, there has been a demand for a simple construction copying apparatus capable of at least two different types of copying operations.

SUMMARY OF THE INVENTION

The present invention is contrived in consideration of these circumstances, and is intended to provide a copying apparatus of a simple construction capable of performing at least two different types of copying operations.

According to an aspect of the present invention, there is provided a copying apparatus comprising a photosensitive body, and a developing device which includes a first storage chamber for storing a first developer, a second storage chamber adjacent to the first storage chamber for storing a second developer, and a developing roller having an outer peripheral surface consisting of a first portion facing the photosensitive body, a second portion located inside the first storage chamber, and a third portion located inside the second storage chamber, and rotatable in one direction and in the other direction opposite thereto so that the first developer is supplied from the first storage chamber to the photosensitive body when the developing roller rotates in the one direction, and that the second developer is supplied from the second storage chamber to the photosensitive body when the developing roller rotates in the other direction.

DETAILED DESCRIPTION OF THE PREFERRED EMBODIMENTS

There will now be described in detail the case in which a copying apparatus according to a first embodiment of the present invention is applied to an electrostatic copying machine, with reference to the accompanying drawings to FIGS. 1 to 6.

Figure 1:
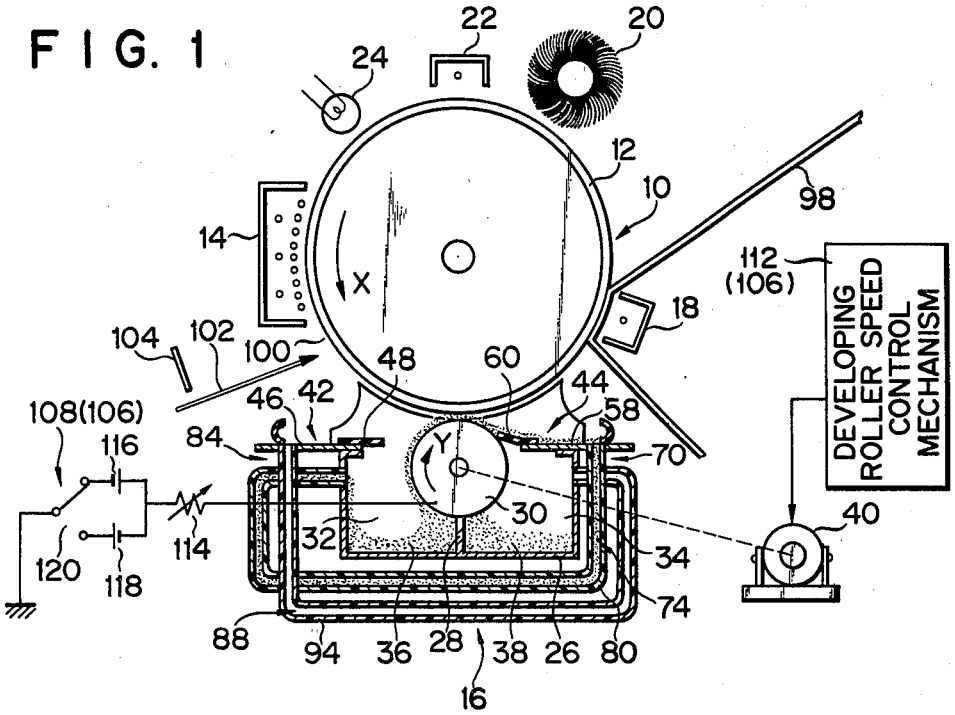
FIG. 1 is a side view schematically showing a copying apparatus according to a first embodiment of the present invention.
Figure 2:
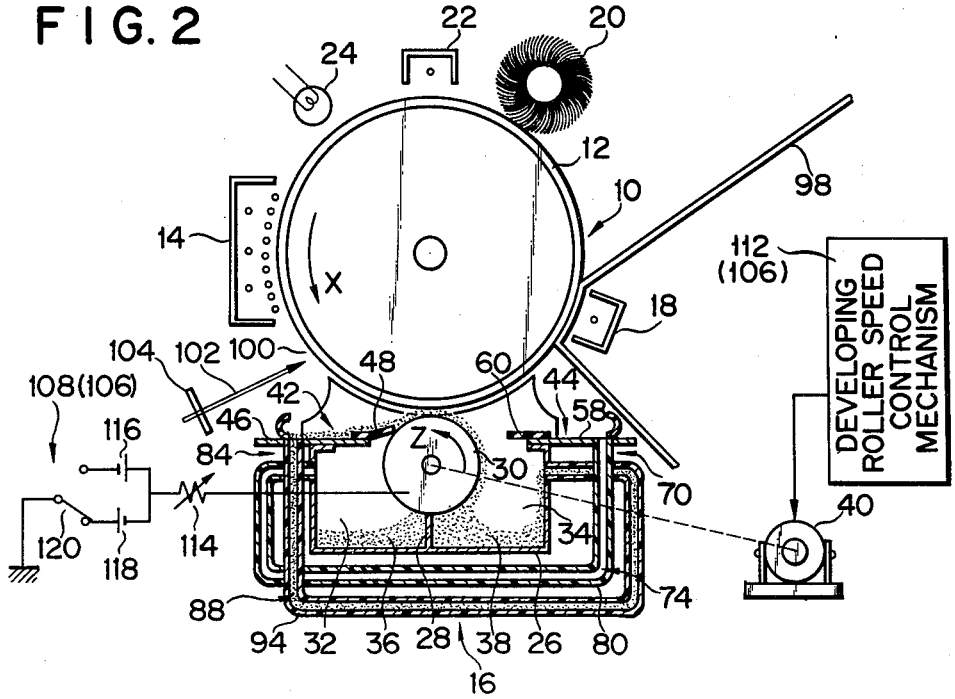
FIG. 2 is a side view of the apparatus of FIG. 1 in an operating state different from the state shown in FIG. 1.

Referring now to FIGS. 1 and 2, numeral 10 designates a photosensitive drum which is rotatably disposed in a housing (not shown) of the electrostatic copying machine. The photosensitive drum 10 is driven by a driving mechanism (not shown) to rotate in the counterclockwise direction as indicated by an arrow X. Laid on the outer peripheral surface of the photosensitive drum 10 is a photosensitive layer 12, containing e.g. CdS, on which plus- or minus-polarity surface potential is selectively formed as required. Inside the housing of electrostatic copying machine, a charger 14, a developing device 16, a transfer device 18, a cleaning device 20, a discharger 22, and a discharging lamp 24 are successively arranged around the photosensitive drum 10 along the rotating direction thereof. The charger 14 can selectively charge the photosensitive layer 12 of the photosensitive drum 10 with plus- or minus-polarity. The cleaning device 20 is so designed as to be able to be moved between a position where it comes in contact with the photosensitive layer 12 and a non-contact position by a shifting mechanism (not shown). In the position to touch the photosensitive layer 12, the cleaning device 20 removes toner as a developer remaining on the photosensitive layer 12 to clean the same. In the non-contact position, however, the cleaning device 20 is kept from cleaning the photosensitive layer 12.

The developing device 16 is disposed in close vicinity to the surface of the photosensitive drum 10, and is provided with an open-topped, box-shaped container 26. The container 26 has a partition plate 28 therein rising from the bottom to the middle of the interior of the container 26. A single developing roller 30 as feeding means is so disposed inside the container 26 as to be rotatable on a rotation axis parallel to the rotation axis of the photosensitive drum 10. The bottom end of the developing roller 30 is slidably in contact with the top edge of the partition plate 28, and the top end of the developing roller 30 is projected above the top edge of the container 26 through the top opening thereof to face the photosensitive layer 12. The inside space of the container 26 is divided right and left by the partition plate 28 and the developing roller 30 into two adjacent parts; first and second storage chambers 32 and 34. The first and second storage chambers 32 and 34 are isolated from each other. A first toner 36 as a first developer is stored in the first storage chamber 32, while a second toner 38 as a second developer is stored in the second storage chamber 34. The first toner 36 has minus charging polarity and is colored red, while the second toner 38, which has smaller electrostatic capacity, has plus charging polarity and is colored black.

The developing roller 30 is connected to a first reversible motor 40, and is driven by the motor 40 to rotate selectively in the clockwise direction, as indicated by an arrow Y in FIG. 1, or in the counterclockwise direction, as indicated by an arrow Z in FIG. 2. Further, the developing roller 30 is formed of a magnetic roller, and both the first and second toners 36 and 38 are composed of one-component toners.

Figure 3:
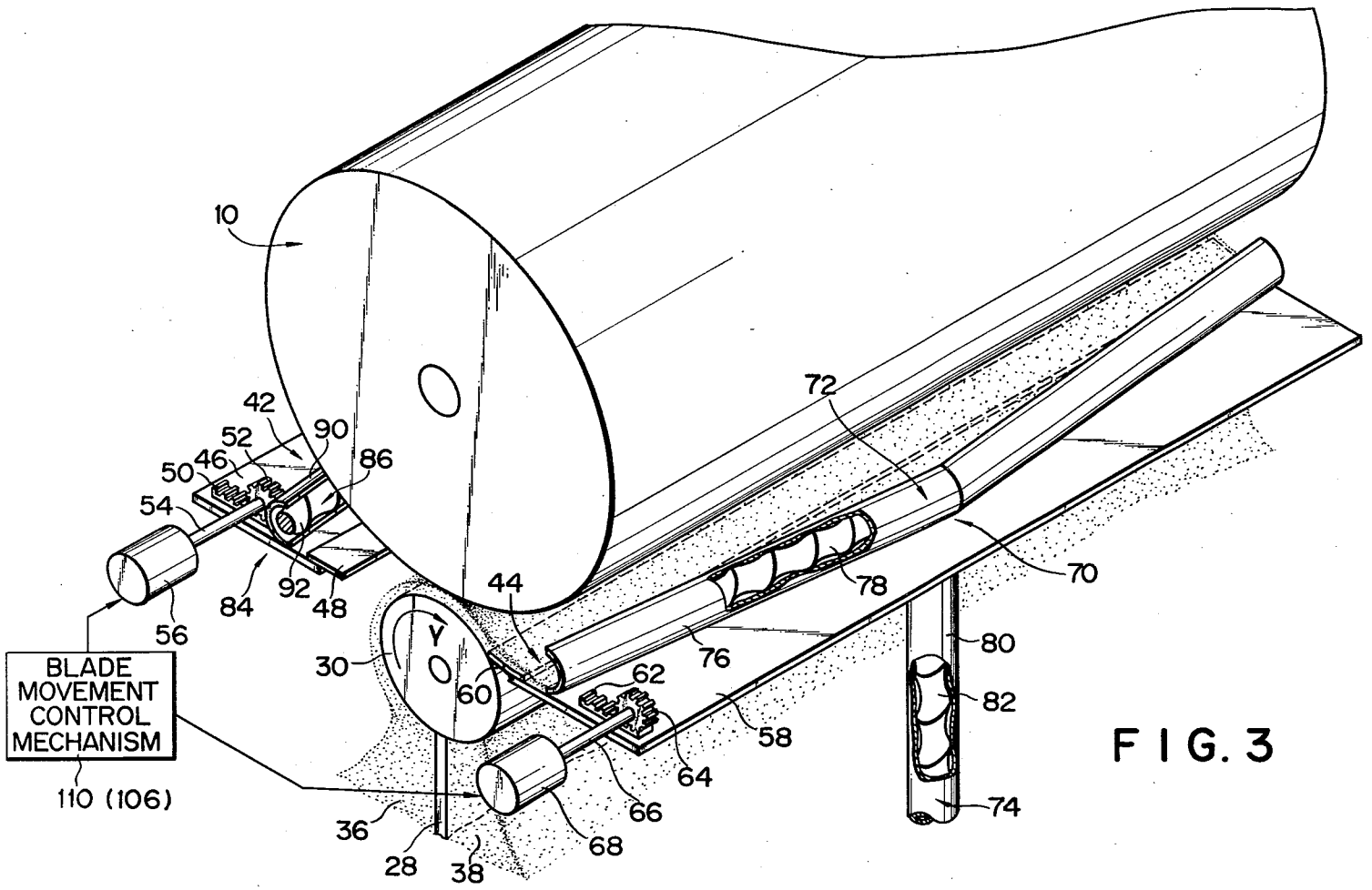
FIG. 3 is a perspective view of a developing device in the state shown in FIG. 1.
Figure 4:
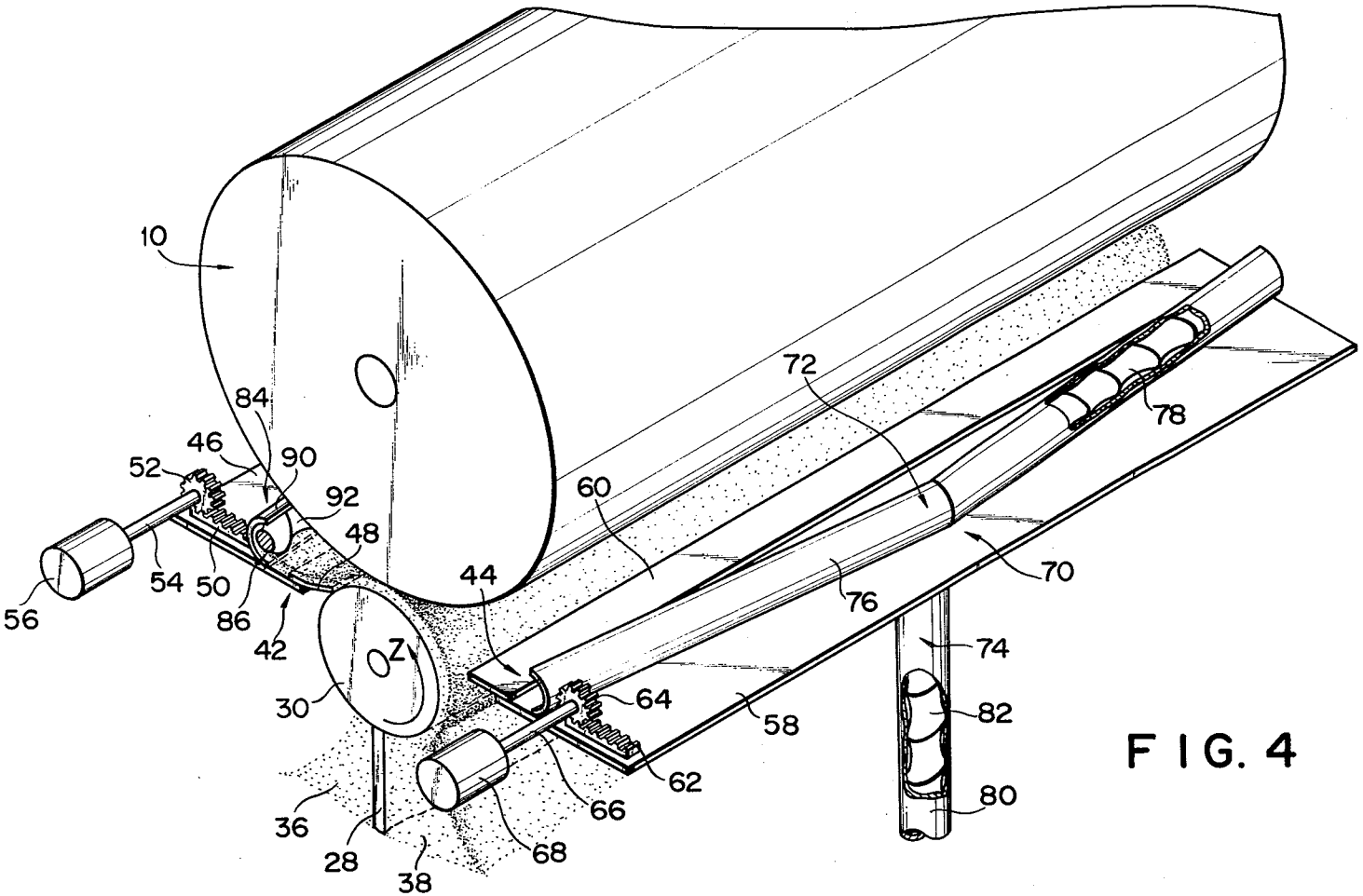
FIG. 4 is a perspective view of the developing device in the state shown in FIG. 2.

First and second shutter mechanisms 42 and 44 are attached to the top of the container 26 to close up the first and second containers 32 and 34, respectively. As shown in FIGS. 3 and 4, the first shutter mechanism 42 includes a first mounting plate 46 movably attached to the upper left portion of the container, and a first blade 48 fixed to that right side edge portion of the first mounting plate 46 which faces the developing roller 30 and capable of engaging the left side portion of the surface of the developing roller 30 along the axial direction thereof accompanying the movement of the first mounting plate 46. Fixed on the first mounting plate 46 is a first rack 50 which extends along the moving direction of the first mounting plate 46. Further provided is a second reversible motor 56 which has a first driving shaft 54 fitted at the tip with a first pinion 52 intermeshing with the first rack 50.

On the other hand, the second shutter mechanism 44 includes a second mounting plate 58 movably attached to the upper right portion of the container 26, and a second blade 60 fixed to that left side edge portion of the second mounting plate 58 which faces the developing roller 30 and capable of engaging the right side portion of the surface of the developing roller 30 along the axial direction thereof accompanying the movement of the second mounting plate 58. Fixed on the second mounting plate 58 is a second rack 62 which extends along the moving direction of the second mounting plate 58. Further provided is a third reversible motor 68 which has a second driving shaft 66 fitted at the tip with a second pinion 64 intermeshing with the second rack 62. The first and second blades 48 and 60 are pressed against the surface of the developing roller 30 with a force small enough to allow the rotation of the developing roller 30 and great enough for the blades to scrape off the toners 36 and 38 on the developing roller 30, respectively.

In contact with the second blade 60 of the second shutter mechanism 44, as shown in FIG. 1, the developing roller 30 is rotated in the direction of the arrow Y by the first motor 40 to supply the first red toner 36 stored in the first storage chamber 32 onto the photosensitive layer 12, adsorbing the toner 36 on its surface. In contact with the first blade 48 of the first shutter mechanism 42, as shown in FIG. 2, the developing roller 30 is rotated in the direction of the arrow Z by the first motor 40 to supply the second black toner 38 stored in the second storage chamber 34 onto the photosensitive layer 12, adsorbing the toner 38 on its surface.

Provided on the top of the container 26 is a first collecting mechanism 70 for collecting the residual first toner 36, which is supplied to the photosensitive drum 10 to take no part in the development, and for delivering the collected toner to the first storage chamber 32. As shown in FIG. 3, the first collecting mechanism 70 is provided with a first collector 72 mounted on the second mounting plate 58 so as to adjoin the second blade 60, whereby the first red toner 36 scraped off from the surface of the developing roller 30 by the second blade 60 is collected, and a first conveyor 74 for carrying the first red toner 36 collected by the first collector 72 into the first storage chamber 32. The first collector 72 includes a first receiver 76 having a semicircular section and having its opening portion directed toward the region between the developing roller 30 and the photosensitive drum 10, and a first auger 78 contained in the first receiver 76 to be rotated by a driving mechanism (not shown), whereby the first red toner 36 received in the first receiver 76 is concentrated in the central portion thereof. As for the first conveyor 74, it includes a hollow cylindrical first duct 80 connecting the central portion of the first receiver 76 with the first storage chamber 32, and a second auger 82 contained in the first duct 80 to be rotated by a driving mechanism (not shown), whereby the first red toner 36 concentrated in the central portion of the first receiver 76 is carried into the first storage chamber 32 through the first duct 80.

Provided on the top of the container 26, moreover, is a second collecting mechanism 84 for collecting the residual second toner 38, which is supplied to the photosensitive drum 10 to take no part in the development, and for delivering the collected toner to the second storage chamber 34. As shown in FIG. 3, the second collecting mechanism 84 is provided with a second collector 86 mounted on the first mounting plate 46 so as to adjoin the first blade 48, whereby the second black toner 38 scraped off from the surface of the developing roller 30 by the first blade 48 is collected, and a second conveyor 88 for carrying the second black toner 38 collected by the second collector 86 into the second storage chamber 34. The second collector 86 includes a second receiver 90 having a semicircular section and having its opening portion directed toward the region between the developing roller 30 and the photosensitive drum 10, and a third auger 92 contained in the second receiver 90 to be rotated by a driving mechanism (not shown), whereby the second red toner 38 received in the second receiver 90 is concentrated in the central portion thereof. As for the second conveyor 88, it includes a hollow cylindrical second duct 94 (shown in FIGS. 1 and 2) connecting the central portion of the second receiver 90 with the second storage chamber 34, and a fourth auger (not shown) contained in the second duct 94 to be rotated by a driving mechanism (not shown), whereby the second black toner 38 concentrated in the central portion of the second receiver 90 is carried into the second storage chamber 34 through the second duct 94.

In FIGS. 1 and 2, a copying paper conveyor bath 98 is provided between the transfer device 18 and the surface of the photosensitive layer 12. Numeral 100 designates an exposure portion of the photosensitive layer 12. Further, a red filter 104 is disposed in an optical path 102 leading to the exposure portion 100. The red filter 104 may be removed from the optical path 102, as need arises.

The developing device 16 thus constructed is provided with a control mechanism 106 for changing the developing condition according to the rotating direction of the developing roller 30 to ensure constant developing density (i.e., copying density) without regard to the developing color. The control mechanism 106 includes a bias voltage/polarity control mechanism 108 as a first control mechanism, a blade movement control mechanism 110 as a second control mechanism, and a developing roller speed control mechanism 112 as a third control mechanism. The bias voltage/polarity control mechanism 108, which controls the change of the bias voltage and bias polarity to the developing roller 30 in accordance with the rotating direction of the developing roller 30, is composed of a variable resistor 114, two DC power sources 116 and 118, and a changeover switch 120. The movable contact of the changeover switch 120 is grounded, one fixed contact thereof is connected to the cathode of the one power source 116, and the other fixed contact is connected to the anode of the other power source 118. Further, the anode of the one power source 116 and the cathode of the other power source 118 are both connected to one end of the variable resistor 114. The other end of the variable resistor 114 is connected to the developing roller 30. Thus, the bias voltage to the developing roller 30 is controlled through the variable resistor 114, while the bias polarity to the developing roller 30 is controlled through the changeover switch 120. Namely, in the bias voltage/polarity control mechanism 108, the movable contact of the changeover switch 120 is connected to the one fixed contact to apply a plus-polarity bias voltage to the developing roller 30 when the developing roller 30 rotates in the direction of the arrow Y, as shown in FIG. 1, to supply the first red toner 36 to the surface of the photosensitive drum 10. On the other hand, when the developiing roller 30 rotates in the direction of the arrow Z, as shown in FIG. 2, to supply the second black toner 38 to the surface of the photosensitive drum 10, the movable contact of the changeover switch 120 is connected to the other fixed contact to supply the developing roller 30 with a minus-polarity bias voltage of a magnitude higher than that of the bias voltage applied to the developing roller 30 rotating in the direction of the arrow Y.

The blade movement control mechanism 110 controls the second and third reversible motors 56 and 68 so that the distances from the respective edges of the first and second blades 48 and 60 to the photosensitive layer 12 may change according to the rotating direction of the developing roller 30. Thus, the respective thicknesses of the first and second toners 36 and 38 sticking to the developing roller 30 to be supplied to the surface of the photosensitive drum 10 are controlled according to the rotating direction of the developing roller 30. Controlled by the blade movement control mechanism 110, the thickness of the second toner 38 obtained when the developing roller 30 rotates in the direction of the arrow Z is made thicker than that of the first toner 36 obtained when the roller 30 rotates in the direction of the arrow Y.

As for the developing roller speed control mechanisn 112, it controls the first reversible motor 40 so that the rotation speed of the developing roller 30 may change according to its rotating direction. By such control, the developing roller 30 is rotated faster in the direction of the arrow Z than in the direction of the arrow Y.

Figures 5A, 5B, 5C, 5D, 5E:
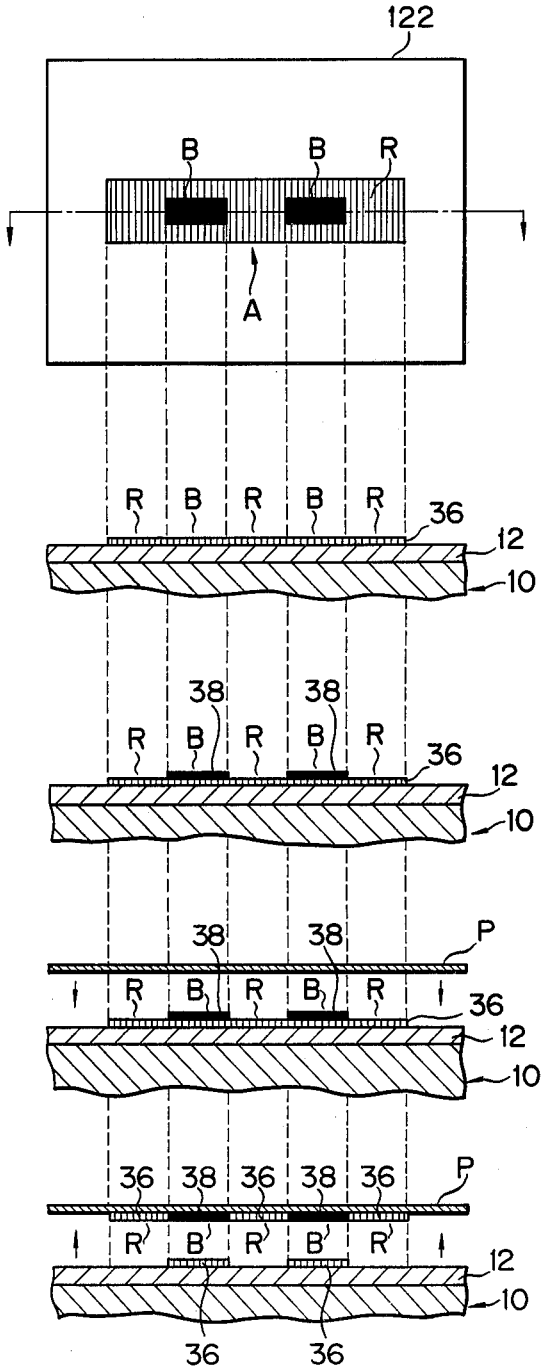
FIG. 5A is a plan view of an example of an original document used in the first embodiment.
FIGS. 5B to 5E are sectional views showing various operating states for illustrating several copying processes.

There will now be described the operation of the first embodiment of the above-mentioned construction, in which an original document 122 bearing a figure A as shown in FIG. 5A is to be copied. In FIG. 5A, the figure A is composed of black portions B and a red portion R.

First, in a first cycle of rotation of the photosensitive drum 10, the charger 14 charges the photosensitive layer 12 for plus-polarity. An electrostatic latent image corresponding to the entire figure A of the document 122 is formed on the exposure portion 100 of the photosensitive layer 12. Then, the developing roller 30 is driven to rotate in the direction of the arrow Y, as shown in FIG. 1, a plus-polarity bias voltage is applied to the developing roller 30 through the bias voltage/-polarity control mechanism 108, and the first shutter mechanism 42 is released to open the first storage chamber 32. Accordingly, the first red toner 36 with minus charging polarity is supplied to the surface of the photosensitive drum 10, and the electrostatic latent image corresponding to the entire figure A (i.e., combined picture including the portions B and R) of the document 122 is developed all in red, as shown in the sectional view of FIG. 5B.

As shown in FIG. 3, moreover, the first shutter mechanism 42 is released to open the first storage chamber 32, and the second storage chamber 34 is closed by the second shutter mechanism 44. The first red toner 36 scraped off from the developiing roller 30 by the second blade 60 of the second shutter mechanism 44 is collected in the first storage chamber 32 by means of the first collecting mechanism 70.

Although the portion of the photosensitive drum 10 developed in red passes by the transfer device 18, the transfer device 18 does not operate during the first revolution of the drum 10, and copying paper P is not supplied from a paper feeding mechanism (not shown). During the first revolution of the photosensitive drum 10, moreover, the cleaning device 20 is separated from the surface of the photosensitive drum 10. Therefore, the first red toner 36 forming a red image on the photosensitive drum 10 will not be removed from the surface of the drum 10.

When the first cycle of development by the first red toner 36 is completed, the first shutter mechanism 42 closes up the first storage chamber 32. Accordingly, the first red toner 36 ceases to be supplied from the first storage chamber 32 to the photosensitive drum 10. Since the developing roller 30 continues to rotate in the direction of the arrow Y, the first red toner 36 between the developing roller 30 and the photosensitive drum 10 is pushed out toward the first collecting mechanism 70, and all collected in the first storage chamber 32 by means of the first collecting mechanism 70. Namely, in the state shown in FIG. 6, the first red toner 36 ceases to remain on that portion of the developing roller 30 which faces the photosensitive drum 10.

Subsequently, the photosensitive drum 10 starts a second cycle of rotation. During the second revolution of the photosensitive drum 10, the charger 14 charges the photosensitive layer 12 for minus-polarity. An electrostatic latent image corresponding to the black portions B of the document 122 is formed on the exposure portion 100 of the photosensitive layer 12. The light for forming the electrostatic latent image corresponding only to the black portions B may be obtained by transmitting a reflected light from the document 122 through the red optical filter 104 (filter to absorb a red color) located in the optical path 102. Then, the developing roller 30 is driven to rotate in the direction of the arrow Z, as shown in FIG. 2, a minus-polarity bias voltage is applied to the developing roller 30 through the bias voltage/polarity control mechanism 108, and the second shutter mechanism 44 is released to open the second storage chamber 34. Accordingly, the second black toner 38 with plus charging polarity is supplied to the surface of the photosensitive drum 10, and the electrostatic latent image corresponding to the black portions B of the figure A is developed in black, as shown in FIG. 5C. Here the developed image corresponding to the portions B bearing the second black toner 38 is superposed on the developed image corresponding to the portions B bearing the first red toner 36.

As shown in FIG. 4, moreover, the first storage chamber 32 is closed by the first shutter mechanism 42, and the second shutter mechanism 44 is released to open the second storage chamber 34. The second black toner 38 scraped off from the developing roller 30 by the first blade 48 of the first shutter mechanism 42 is collected in the second storage chamber 34 by means of the second collecting mechanism 84.

The portion of the photosensitive drum 10 developed in this way passes by the transfer device 18. During the second revolution of the photosensitive drum 10, the transfer device 18 operates, and a sheet of copying paper P is supplied from the paper feeding mechanism (not shown) and brought to a predetermined position, as shown in FIG. 5D. Then, the first and second toners 36 and 38 directly in contact with the copying paper P are transferred to the copying paper P, as shown in FIG. 5E. At this time, the second black toner 38 is transferred to the portions of the copying paper P corresponding to the portions B, while the first red toner 36 is transferred to the portion of the copying paper P corresponding to the portion R. Not directly in contact with the copying paper P, the first red toner 36 sticking to the portions of the photosensitive layer 12 corresponding to the portions B during the first revolution of the drum 10 remains on the photosensitive layer 12 without being transferred.

The copying paper P, to which the red and black toners are transferred in accordance with the figure A of the document 122, is led to a fixing device (not shown) through the copying paper conveyor path 98. Both toners 36 and 38 attached to the copying paper P by the transfer operation is fixed to the copying paper P by the fixing device. After such fixing, the copying paper P is taken out of the apparatus through a paper discharge opening (not shown), and the series of copying operations are completed.

Figure 6:
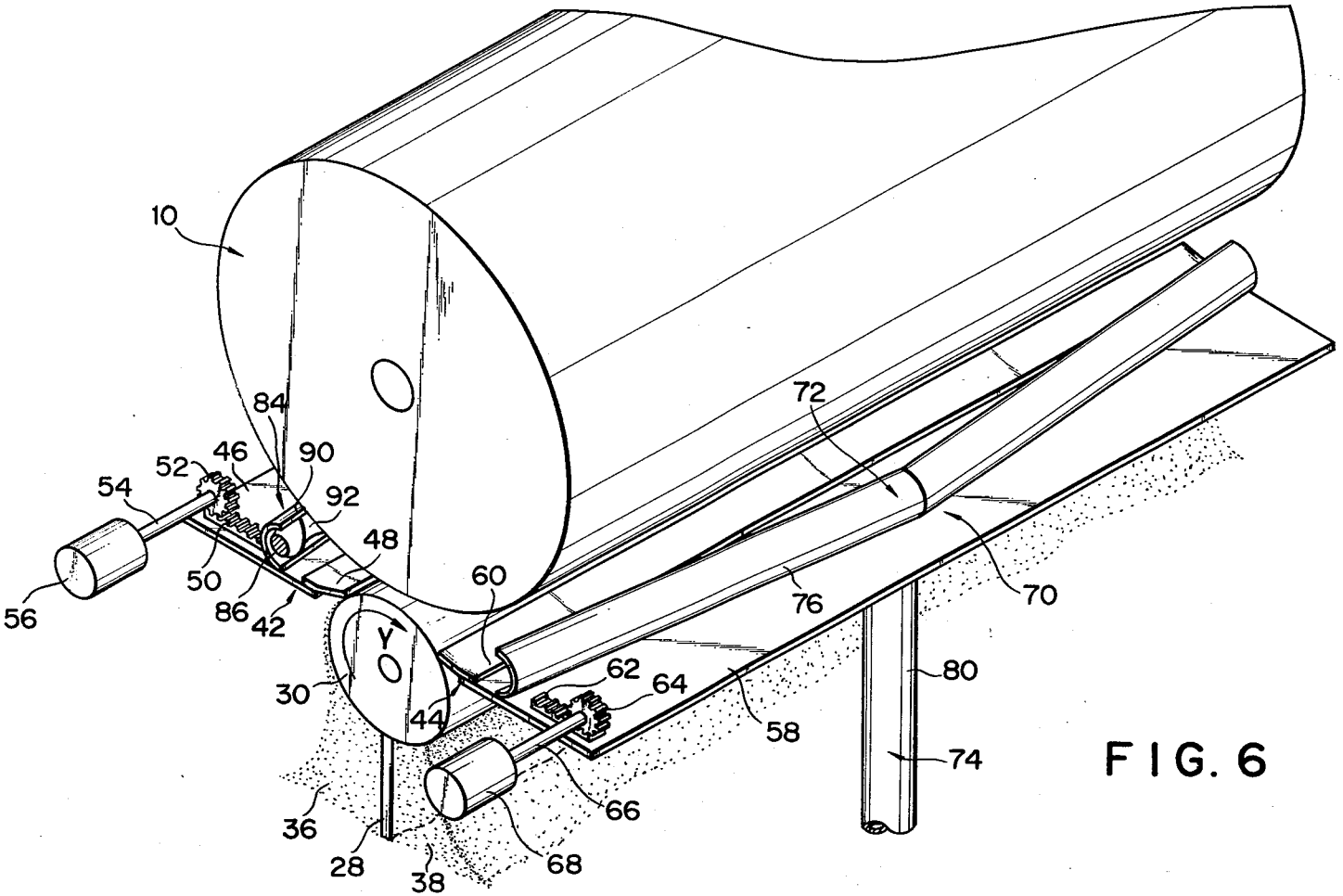
FIG. 6 is a perspective view of the apparatus of FIG. 1 is an operating state different from the states shown in FIGS. 3 and 4.

During the second revolution of the photosensitive drum 10, moreover, the cleaning device 20 is so moved as to be in contact with the photosensitive layer 12, and removes the first and second toners 36 and 38 remaining on the photosensitive layer 12. At the end of the second cycle of development by the second black toner 38, the second shutter mechanism 44 closes up the second storage chamber 34 again, as shown in FIG. 6. As a result, the second toner 38 ceases to be supplied from the second storage chamber 34 to the photosensitive drum 10. Meanwhile, the developing roller 30 continues to rotate in the direction of the arrow Z, so that the second black toner 38 between the developing roller 30 and the photosensitive drum 10 is collected in the second storage chamber 34 by means of the second collecting mechanism 84. Namely, the second black toner 38 entirely ceases to remain on that portion of the developing roller 30 which faces the photosensitive drum 10.

Thus, according to the first embodiment of the invention, one cycle of copying operation is completed by two revolutions of the photosensitive drum 10. During the first revolution of the photosensitive drum 10, the developing roller 30 is rotated in the direction of the arrow Y to supply the first toner 36 to the photosensitive drum 10. During the second revolution of the photosensitive drum 10, the developing roller 30 is rotated in the direction of the arrow Z opposite to the direction of the arrow Y to supply the second black toner 38 to the photosensitive drum 10. Thus, two-color copying on a single sheet of copying paper can be achieved by using a single developing device.

Different in polarity, moreover, the first and second toners 36 and 38 used are free from electrical interrepulsion, so that the toner image on the photosensitive drum 10 will suffer no blur, thus ensuring the production of a clear copy image.

Further, the developing device 30 is provided with the control mechanism 106, in which the bias voltage/polarity control mechanism 108 controls the bias voltage so that the potential difference between the photosensitive drum 10 and the developing roller 30 may be greater when the developing roller 30 rotates in the direction of the arrow Z than when the roller 30 rotates in the direction of the arrow Y. Therefore, even if the charge level of the second toner 38 is lower than that of the first toner 36, or if the developing time varies with the rotating direction of the developing roller 30, the respective liabilities of the first and second toners 36 and 38 to be attracted to the photosensitive drum 10 are controlled to keep the toner supply constant. Thus, the developing densities provided by the first and second toners 36 and 38 are made substantially equal.

Further, the drive of the first and second blades 48 and 60 are controlled by the blade movement control mechanism 110 so that the layer of the second toner 38 obtained through the rotation of the developing roller 30 in the direction of the arrow Z is thicker than the layer of the first toner 36 obtained through the rotation of the roller 30 in the direction of the arrow Y. Accordingly, the photosensitive drum 10 is buried more deeply under the toner layer to make wider the contact width between the photosensitive drum 10 and the toner layer when the developing roller 30 rotates in the direction of the arrow Z than when it rotates in the direction of the arrow Y. Thus, the developing time may be controlled, and the blade movement control mechanism 110, along with the bias voltage/polarity control mechanism 108, can additionally ensure the uniformity of developing density between the toner images.

Moreover, the developing roller speed control mechanism 112 controls the developing roller 30 so that it may rotate faster in the direction of the arrow Z than in the direction of the arrow Y. Accordingly, the developing time may be controlled in accordance with the rotating direction of the developing roller 30. Thus, the developing roller speed control mechanism 112, as well as the bias voltage/polarity control mechanism 108 and the blade movement control mechanism 110, can further improve the uniformity of developing density between the toner images.

The present invention is not limited to the construction of the above-mentioned first embodiment, and various changes and modifications may be effected therein by one skilled in the art without departing from the scope or spirit of the invention.

In the first embodiment, for example, the two-color copying is achieved with use of the red toner 36 as a first developer and the black toner 38 as a second developer. These colors, however, are given only by way of example, and any other colors may be chosen freely. Further, the present invention is not limited to the developing device capable of two-color copying, and has an aspect in which two different types of copying operations are effected with use of a single developing device. Therefore, toners of the same color may be used for the first and second developers so that the quality of the copy image may be changed as required according to the rotating direction of the developing roller 30.

Figure 7:
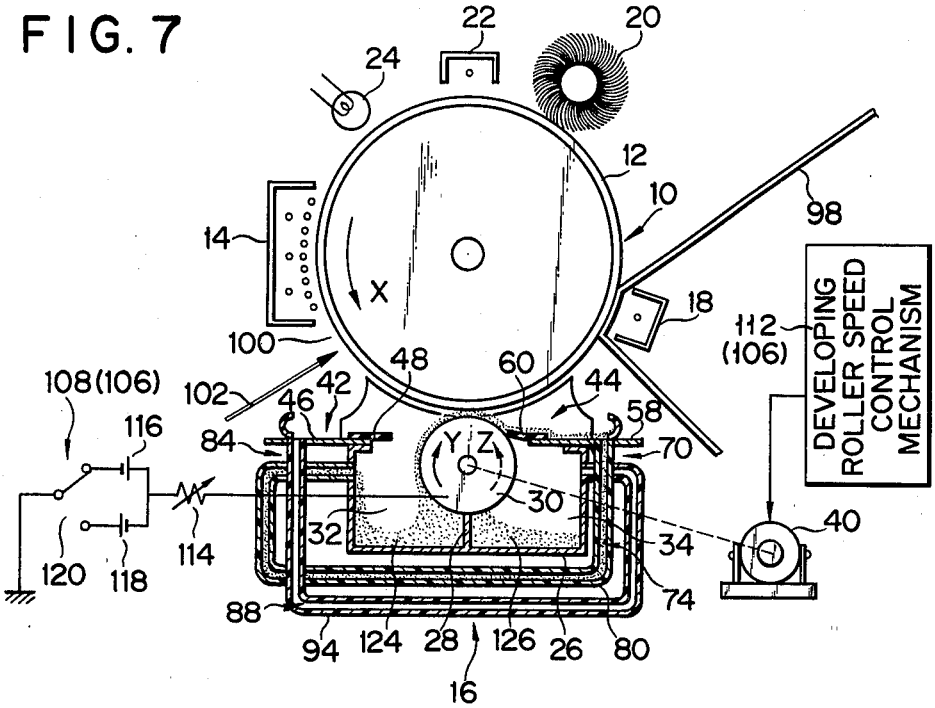
FIG. 7 is a side view schematically showing a copying apparatus according to a second embodiment of the invention.
Figure 8:
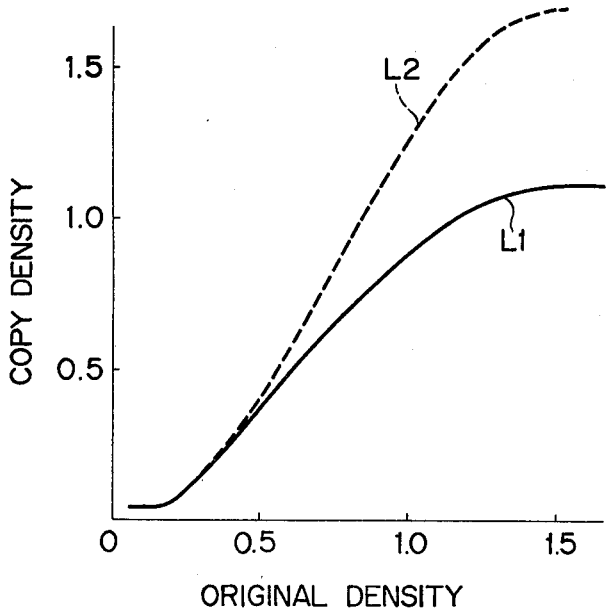
FIG. 8 is a diagram showing the relationship between the copy density provided by the apparatus of FIG. 7 and the original density of the original document.

FIGS. 7 and 8 show a second embodiment of the present invention. In the description to follow, like reference numerals refer to like portions used in the aforementioned first embodiment.

In FIG. 7, the first developer is composed of a black, one-component toner 124, while the second developer is composed of a black, two-component toner 126. In this second embodiment, one cycle of copying operation is completed with every revolution of the photosensitive drum 10. Accordingly, the photosensitive layer 12 may be formed of a photoconductor capable of being charged positively or negatively, and the charger 14 is required only to charge the photosensitive layer 12 positively or negatively.

When using the first developer 124 for copying, the developing roller 30 is rotated in the direction of the arrow Y. Here the rotation of the developing roller 30 in the direction of the arrow Y implies that the photosensitive drum 10 and the developing roller 30 advance in the same direction within the developing range despite the difference in rotating direction. Accordingly, the relative moving speed between the developing roller 30 and the photosensitive drum 10 may be very low, if not zero. In a copy image thus obtained, as represented by a solid line L1 in FIG. 8, the copy density is lower than the original density. This indicates high intermediate-brightness reproducibility of the image. Originally, the one-component toner is high in intermediate-brightness reproducibility. In the second embodiment, one such one-component toner is used for the first developer 124, which is supplied to the photosensitive drum 10 as the drum 10 and the developing roller 30 advance in the same direction. Thus, the intermediate-brightness reproducibility is very high. Such high intermediate-brightness reproducibility as a copy characteristic is best suited for copying from photographs which require reproduction of half tone.

When using the second developer 126 for the copying, on the other hand, the developing roller 30 is rotated in the direction of the arrow Z. Here the rotation of the developing roller 30 in the direction of the arrow Z implies that the photosensitive drum 10 and the developing roller 30 advance in different directions within the developing range despite the sameness in rotating direction. Accordingly, the relative moving speed between the developing roller 30 and the photosensitive drum 10 is very high. In a copy image thus obtained, as represented by a broken line L2 in FIG. 8, the copy density is higher than the original density. This indicates high contrast property of the image. Originally, the two-component toner is good in contrast property. In this second embodiment, one such two-component toner is used for the second developer 126, which is supplied to the photosensitive drum 10 as the drum 10 and the developing roller 30 advance in the different directions. Thus, the contrast property of the copy image is quite satisfactory. Such satisfactory contrast property as a copy characteristic is best suited for the copying of typescripts or drawings.

Thus, according to the second embodiment, there may be provided an electrostatic copying machine capable of selectively performing copying operations for high intermediate-brightness reproducibility and for high contrast property by the use of a single developing device.

Figure 9:
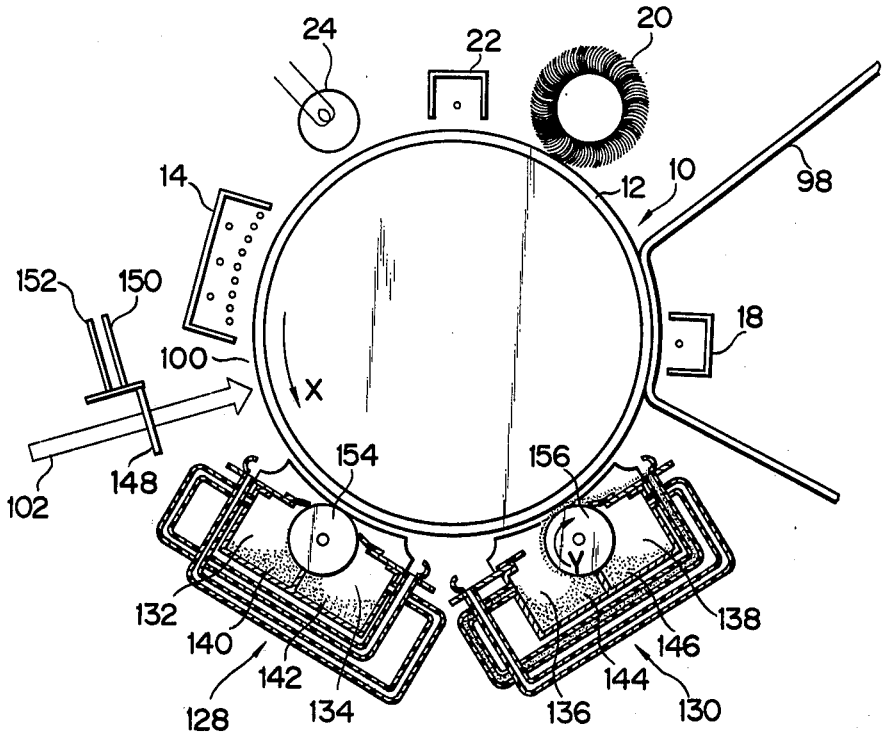
FIG. 9 is a side view schematically showing a copying apparatus according to a third embodiment of the invention.

FIG. 9 shows a third embodiment of the present invention. In the aforementioned first embodiment, the electrostatic copying machine performs tow-color copying with use of the single developing device 30. The present invention is not, however, limited to the use of the single developing device 30, and may also be applied to a copying apparatus with a plurality of developing devices for performing copying operations of types twice as many as the devices. As shown as the third embodiment in FIG. 9, for example, four-color copying may be achieved by using two developing devices 128 and 130.

Having the same construction of the developing device 30 of the first embodiment, the first and second developing devices 128 and 130 are arranged along the rotating direction of the photosensitive drum 10. The first developing device 128 includes first and second storage chambers 132 and 134, and the second developing device 130 includes third and fourth storage chambers 136 and 138. Cyan toner 140 as a first developer, magenta toner 142 as a second developer, yellow toner 144 as a third developer, and black toner 146 as a fourth developer are stored in the first, second, third and fourth storage chambers 132, 134, 136 and 138, respectively. Further, a red filter 148, a green filter 150, and a blue filter 152 are so disposed as to be able to cross independently the optical path 102 from the original document to the exposure portion 100.

In this case, four-color copying on a single sheet of copying paper is accomplished by four revolutions of the photosensitive drum 10. During the first revolution of the photosensitive drum 10, none of the filters 148, 150 and 152 cross the optical path 102, and an electrostatic latent image is formed on the basis of a reflected light from the original document. This electrostatic latent image is developed by the black toner 146 which is supplied as a second developing roller 156 of the second developing device 130 rotates in the direction of the arrow Z. During the second revolution of the photosensitive drum 10, the red filter 148 crosses the optical path 102, and an electrostatic latent image based on the reflected light from the original document transmitted through the red filter 48 is superposed on the aforesaid image developed by the black toner 146. This electrostatic latent image is developed by the cyan toner 140 which is supplied as a first developing roller 154 of the first developing device 128 rotates in the direction of the arrow Y. During the third revolution of the photosensitive drum 10, the green filter 150 crosses the optical path 102, and an electrostatic latent image based on the reflected light from the original document transmitted through the green filter 150 is superposed on the aforesaid images developed by the black toner 146 and the cyan toner 140. This electrostatic latent image is developed by the magenta toner 142 which is supplied as the first developing roller 154 of the first developing device 128 rotates in the direction of the arrow Z. During the fourth revolution of the photosensitive drum 10, moreover, the blue filter 152 crosses the optical path 102, and an electrostatic latent image based on the reflected light from the original document transmitted through the blue filter 152 is superposed on the aforesaid images developed by the black toner 146, cyan toner 140, and magenta toner 142. This electrostatic latent image is developed by the yellow toner 144 which is supplied as the second developing roller 156 of the second developing device 130 rotates in the direction of the arrow Y. The resultant image on the photosensitive layer 12, thus developed with use of four colors as the photosensitive drum 10 makes four revolutions, is transferred to copying paper (not shown) by the transfer device 18.

Thus, according to the third embodiment, the two developing devices 128 and 130 are used for four-color copying. Three-color copying may also be achieved by rotating the developing roller of one developing device only in one direction.

What we claim is:

1. A copying apparatus comprising:

a photosensitive body; and a developing device which includes a first storage chamber for storing a first developer, a second storage chamber adjacent to the first storage chamber for storing a second developer, and a developing roller having an outer peripheral surface consisting of a first portion facing said photosensitive body, a second portion located inside the first storage chamber, and a third portion located inside the second storage chamber, and rotatable in one direction and in the other direction opposite thereto so that the first developer is supplied from the first storage chamber to said photosensitive body when the developing roller rotates in said one direction, and that the second developer is supplied from the second storage chamber to said photosensitive body when the developing roller rotates in said other direction.

2. The copying apparatus according to claim 1, wherein said developing roller is formed of a magnet roller, and said first and second developers have their respective polarities magnetically absorbed by the magnet roller.

3. The copying apparatus according to claim 1, wherein said photosensitive body is rotatable in one direction which is coincident with said one direction in which the developing roller rotates.

4. The copying apparatus according to claim 3, wherein said first and second developers include first and second toners, respectively, of the same color.

5. The copying apparatus according to claim 4, wherein said first developer is formed of a two-component toner, and said second developer is formed of a one-component toner.

6. The copying apparatus according to claim 1, wherein said first developer includes a first toner of a prescribed color, and said second developer includes a second toner of a color different from the color of the first toner.

7. The copying apparatus according to claim 6, which further comprises an exposure device for forming on the photosensitive body an electrostatic latent image corresponding to an image of an original document, said exposure device including a filter of the same color as that of the first toner removably disposed in the optical path of the exposure device.

8. The copying apparatus according to claim 7, wherein said photosensitive body is rotatable in one direction.

9. The copying apparatus according to claim 8, wherein said photosensitive body makes two revolutions to complete a cycle of copying operation, the filter is not in the optical path and the developing roller rotates in said one direction to supply the first toner during the first revolution of the photosensitive body, and the filter is in the optical path and the developing roller rotates in said other direction to supply the second toner during the second revolution of the photosensitive body.

10. The copying apparatus according to claim 1, wherein said developing device includes a first collecting mechanism for collecting in the first storage chamber that portion of the first developer supplied to the photosensitive body as the developing roller rotates in said one direction which takes no part in the developing operation, and a second collecting mechanism for collecting in the second storage chamber that portion of the second developer supplied to the photosensitive body as the developing roller rotates in said other direction which takes no part in the developing operation.

11. The copying apparatus according to claim 1, which further comprises another developing device including a third storage chamber for storing a third developer and a second developing roller having an outer peripheral surface consisting of a fourth portion facing said photosensitive body and a fifth portion located inside the third storage chamber, and rotatable in one direction so that the third developer is supplied from the third storage chamber to said photosensitive body as said second developing roller rotates in said one direction.

12. The copying apparatus according to claim 11, wherein said first, second and third developers include first, second and third toners, respectively, of colors different from one another.

13. The copying apparatus according to claim 11, wherein said another developing device includes a fourth storage chamber adjacent to said third storage chamber for storing a fourth developer, and the outer peripheral surface of said second developing roller includes a sixth portion located inside the fourth storage chamber, and the second developing roller is rotatable in the other direction so that the fourth developer is supplied from the fourth storage chamber to the photosensitive body as the second developing roller rotates in said other direction.

14. The copying apparatus according to claim 13, wherein said first, second, third and fourth developers include first, second, third and fourth toners, respectively, of colors different from one another.

* * * * *